US005246379A

United States Patent [19]

Wright

[11] Patent Number: 5,246,379

[45] Date of Patent: Sep. 21, 1993

[54] ELECTRICAL CONNECTOR AND BACKSHELL ASSEMBLY

[75] Inventor: James R. Wright, Guilford, N.Y.

[73] Assignee: Simmonds Precision Engine Systems, Inc., Akron, Ohio

[21] Appl. No.: 844,112

[22] Filed: Mar. 2, 1992

[51] Int. Cl.[5] ..... H01R 4/38

[52] U.S. Cl. ..... 439/321; 439/320

[58] Field of Search ..... 439/320, 321, 323, 312-319; 285/82, 87-89, 92

[56] References Cited

U.S. PATENT DOCUMENTS

| | | | |
|---|---|---|---|
| 2,728,895 | 12/1955 | Quakenbush | 339/89 |
| 2,784,385 | 3/1957 | Ennis | 339/89 |
| 2,890,434 | 6/1959 | Ray et al. | 339/91 |
| 3,343,852 | 9/1967 | Blight et al. | 439/321 X |
| 3,462,727 | 8/1969 | Blight et al. | 339/89 |
| 3,594,700 | 7/1971 | Nava et al. | 339/89 R |
| 3,663,926 | 5/1972 | Brandt | 339/89 R |
| 3,808,580 | 4/1974 | Johnson | 339/89 R |
| 3,917,373 | 11/1975 | Peterson | 339/89 R |
| 3,971,614 | 7/1976 | Paoli et al. | 339/89 R |
| 4,030,798 | 6/1977 | Paoli | 339/89 R |
| 4,285,564 | 8/1981 | Spinner | 339/89 C |
| 4,291,933 | 9/1981 | Kakaris | 439/321 |
| 4,359,254 | 11/1982 | Gallusser et al. | 339/89 M |
| 4,484,790 | 11/1984 | Schildkraut et al. | 439/312 |
| 4,703,988 | 11/1987 | Raux et al. | 439/321 |
| 4,746,303 | 5/1988 | Cobraiville et al. | 439/321 |
| 4,808,123 | 2/1989 | Dee et al. | 439/321 X |
| 4,834,667 | 5/1989 | Fowler et al. | 439/321 |
| 4,900,260 | 2/1990 | Drogo | 439/321 |
| 5,046,964 | 9/1991 | Welsh et al. | 439/321 X |
| 5,082,454 | 1/1992 | Tonkiss et al. | 439/320 |

FOREIGN PATENT DOCUMENTS

| | | | |
|---|---|---|---|
| 151896 | 10/1920 | United Kingdom | 439/320 |

*Primary Examiner*—David L. Pirlot

*Attorney, Agent, or Firm*—William E. Zitelli; Jay R. Campbell

[57] ABSTRACT

An electrical connector segment, for use in industrial and transportation application, which provides engagement to another complementary coupler segment with fine incremental adjustment and prevents disengagement from vibration, jarring and shock and by those unfamiliar with its function, including a backshell assembly for joining an electrical cable to the connector segment, with the same features plus means by which ready access is provided to the juncture, of the wire leads of the cable, with the connector elements within the connector segment for maintenance, repair and modification.

15 Claims, 3 Drawing Sheets

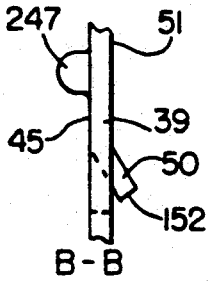
FIG. 8
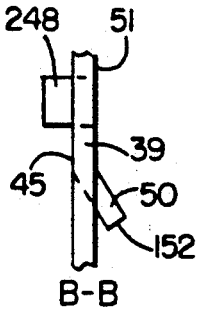
FIG. 9
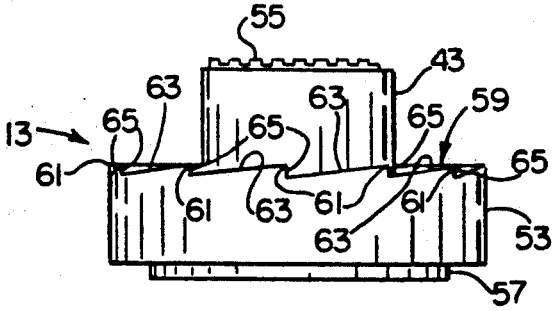
FIG. 10
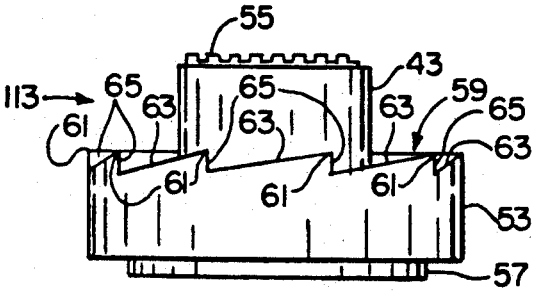
FIG. 12
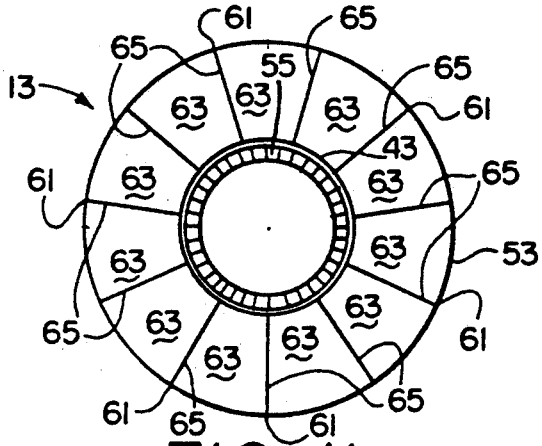
FIG. 11
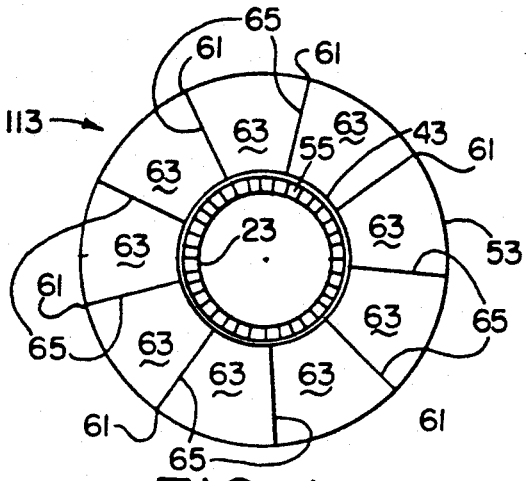
FIG. 13
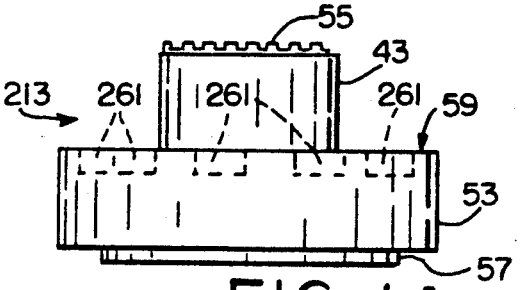
FIG. 14
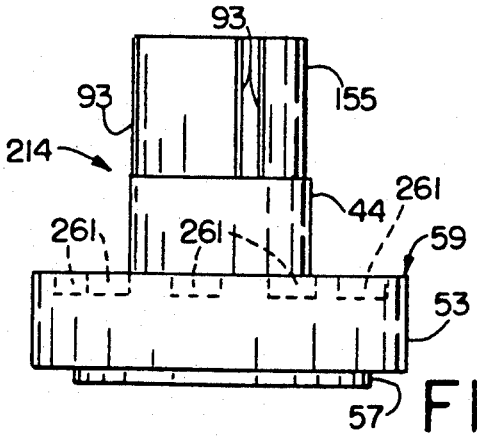
FIG. 16
FIG. 15
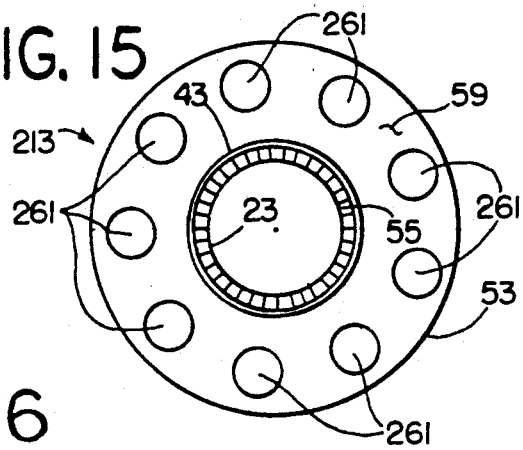

ELECTRICAL CONNECTOR AND BACKSHELL ASSEMBLY

FIELD OF THE INVENTION

The present invention relates generally to the field of connector assemblies, and more specifically to single or multiple pin-type electrical connectors and backshells as used therewith for applications in adverse environments.

BACKGROUND OF THE INVENTION

One of the most prominent means for making electrical connections embodies the concept of inserting a relatively rigid male prong into a mating and conforming female receptacle. Such is the design and arrangement of the common household electrical plug. In many industrial and transportation application, electrical connections in accord with this concept are made with pin-type connectors wherein the male prongs are generally cylindrical in shape, with the corresponding mating female receptacle sockets being in the form of hollow cylindrical shapes, e.g., tubes or tubular members, diametrically sized to accommodate insertion therein of the male pins, generally with some degree of a tight, or interference, fit, to produce acceptable levels of electrical current transmission therebetween and without sufficient localized resistance to produce unacceptable levels of heat build-up and loss of energy. Normally, both the male pin and the female socket are made of materials which are considered good electrical conductors, e.g., metals such as copper-based alloys. The contacting surfaces of these elements may be coated with a softer metallic conductor material, e.g., gold, rhodium, cadmium or nickel, to enhance the area and/or quality of surface contact therebetween and, thus, the transmission of electrical current. The male pin assemblies are normally contained in assemblies referred to herein as male couplers or, simply, couplers; the female receptacle sockets are normally contained in what are referred to herein as female socket assemblies. The assembly of a male coupler and a female socket assembly is variously referred to herein as a connector or connector assembly, with the male coupler and the female socket assembly both being connector segments.

Generally, a backshell is used to join the cable to the connector segment to which that cable is to be mounted. Conventionally, an electrical cable assembly, using one or more connector segments to join the cable to one or more other connector segments, is assembled by first sliding the backshell over the cable. If the backshell is fixed to a part of the connector segment, that part of the connector segment is also slid over the cable. Following this, the individual leads of wire of a given end of the cable are connected, e.g., by soldering, to the corresponding individual wire lead connectors of either a male pin assembly or a female receptacle socket. Frequently, the male pin assembly and the female receptacle socket, respectively, comprise cylindrical discs formed from electrically non-conductive, insulating material, e.g., bakelite, with small, spaced-apart holes formed therethrough in a direction parallel to the cylindrical axis of rotation of the discs.

For the male pin assembly, electrically conductive pins are inserted through the small, spaced-apart holes of the disc, the pins extending from both ends, of the cylindrical section of the disc, which form the faces of the disc. The pin extensions from one face of the disc serve as leads to be connected to the corresponding individual leads of wire in the given cable end, while the extensions from the opposite face of the disc serve as the actual pin sections to be inserted into corresponding individual sockets in the female receptacle socket.

Through the small, spaced-apart holes, of the disc to be used for the female receptacle socket, are inserted electrically conductive tubes or tubular members, usually to extend from only one face of the disc, with the opposite ends of the tubes being flush with the opposite face of the disc. The tube extensions from the one face of the disc serve as leads to be connected to the corresponding leads of wire in a given cable end. The corresponding pin sections, extending from the corresponding disc face of a male pin assembly, can be inserted axially into the tubes or tubular members, which are flush with the other face of the disc of the female receptacle socket, thus bringing the respective corresponding disc faces, of the male pin assembly and the female receptacle socket, into close, face-to-face proximity or abutment.

After either a male pin assembly or a female socket assembly has been connected to the wire leads of a cable end, the backshell is then slid forward along the cable into engagement with either the male coupler or the female socket assembly, as the case may be. Backshells may be assemblies which are generally similar in design, concept, structure and/or function to couplers: The couplers serve to draw the male pin assembly into engagement with a corresponding female receptacle socket, contained in a female socket assembly, to maintain the male pin assembly and the female receptacle socket together and to maintain the coupler and the female socket assembly together, and to provide a way to disengage them, respectively, without resort to the destruction of any of the components thereof; in similar fashion, the backshell assemblies may serve to draw the cable to either the male coupler or female socket assembly, and to hold and maintain the cable in position, thus preventing tension, flexure and stress in relation to the electrical connections formed between the cable wire leads and the wire leads from pins or tubular members of, respectively, the male pin assemblies and the female receptacle sockets.

The similarity between backshell assemblies and couplers depends on whether or not the intent is to enable the disconnection of the backshell assembly from its associated connector segment to enable repairs and/or modifications to be made to the male pin assemblies, the female receptacle sockets and their respective connections to the individual wire leads of the cables; if the intent is to so enable such disconnection, the backshell assemblies may be similar in design, concept, structure and/or function to couplers; if the intent is otherwise, then fundamental difference may be present. Ultimately, the cable must be mounted to a connector segment. In some cases this is done, for example, by crimping a tubular backshell, fixed to and extending from a connector segment, around the coaxial cable end, with the wire leads of that cable end extending through the tubular backshell to either the male pin assembly or the female receptacle socket; this attaches the cable end to the backshell more or less permanently. With such a design it is very difficult, if not impossible, to disassemble the tubular backshell from the cable to provide access to the wire lead connections, without damaging or destroying the backshell, the adjacent end of the cable and/or the associated connector segment and its contents. On the other hand, where a backshell assembly, similar to a coupler, is used, the tubular backshell extends from the backshell assembly, not the associated connector segment, and the backshell assembly can be separated from that connector segment to provide ready access to the wire lead connections, etc.

Where the intent is to enable disconnection of the backshell assembly from its associated connector segment, the adjoining of the backshell may be effected in generally the same manner as the adjoining of a coupler to a complementary female socket assembly, to form a connector assembly. In such a case, the purposes of the backshell assembly may be up to and including fourfold, being firstly, to provide means to mount the cable to the backshell, secondly, to provide means to mount and maintain either the male pin assembly or the female receptacle socket within a connector segment, thirdly, to provide means to disengage either the male pin assembly or the female receptacle socket from that connector segment, and fourthly, to enable access to the connections between the wire leads of the cable and either the male pin assembly or the female receptacle assembly.

In many industrial and transportation applications, electrical connectors are exposed to relatively adverse environments. Further, in particular in transportation applications, electrical connectors must meet specific requirements, e.g., light weight, compact size, strength, capability of functioning satisfactorily at extremes of temperature, wear and fatigue resistance, and general long-term reliability. Unlike the common household plug, industrial and transportation connectors are frequently exposed to long-term periods of heightened vibration, and intermittent physical shock forces. Thus means must be employed to assure that such connectors will not vibrate loose or be otherwise dislodged by shock, thus interrupting the electrical connection during operations. In addition, because the maintenance of uninterrupted electrical connection is, in may situations, quite critical in industrial application, and oft times vital in transportation applications, means must be employed to assure that such connectors are not inadvertently or accidentally disconnected, by jarring or otherwise, during maintenance or repairs.

Much of the equipment presently using electrical connectors, either internally or externally between various elements, is highly complex and sensitive, only rightfully subject to maintenance or repair by experts. Thus, ideally means must be used to insure that unauthorized maintenance or repair cannot readily be attempted. There is also a sinister aspect to consider. With the rise in terrorism, thought must be given to designing connectors and backshell assemblies which are relatively tamper-proof, i.e., which cannot be readily disconnected by hand, without special tools and/or for which the specific means of disassembly are not readily apparent to the uninitiated.

One approach to effecting a relatively tamper-proof connector design is disclosed in U.S. Pat. No. 2,784,385 wherein an electrical connector mechanism is described which cannot facilely be disconnected without multiple tools, and even then, may require two people to actually achieve disconnection; the alternative may be to damage the connector on disassembly, but even then, this would require tools. The assembly of this connector is described in U.S. Pat. No. 2,784,385 as drawing "the conductive connectors into complete and permanent contact with each other", with the system operating on a one-way ratchet, thread tightening principle, but without means to reverse the ratchet and without description of a disassembly procedure or means. But, of course, such an arrangement makes intended maintenance and repairs quite difficult where disassembly of the connector is required. U.S. Pat. No. 2,784,385 does not address or disclose means for mounting a backshell assembly to a connector segment.

Another connector device is disclosed in U.S. Pat. No. 2,890,434 wherein a two-way ratchet, thread tightening principle is used. In this design, the ratchet pawl is resilient and the ratchet teeth are designed to depress the resilient pawl upon rotation, thus permitting either assembly or disassembly of the connector by hand rotation with the application of modest torque. Such a coupler is not tamper-resistant, although it does feature ease of assembly, disassembly and reassembly as necessary for maintenance and repairs. The resistance of such a connector, however, to vibration, shock and jarring, is suspect as the pawl is not designed to be extended to near its limits of resiliency when the connector is assembled. U.S. Pat. No. 2,890,434, like U.S. Pat. No. 2,784,385, does not address or disclose means for mounting a backshell assembly to a connector segment.

U.S. Pat. No. 3,594,700 discloses an extraordinarily complicated and expensive-to-produce connector, with a modified pawl and ratchet tooth arrangement. In one embodiment the ratchet teeth are positioned circumferentially about the inner bore of a nut, with resilient pawls being formed on the outer periphery of a cup-like washer which is prevented from turning by compressive force exerted on the face of the washer by spring means. Conceptually, however, this device functions on the same principle of that disclosed in U.S. Pat. No. 2,890,434 and is subject to the same features and deficiencies. The other embodiment of U.S. Pat. No. 3,594,700 includes a ball and detent arrangement, acting as a ratchet, wherein the balls are mounted on a spring washer means and the mating detents are formed in another washer which is likewise prevented from turning by compressive force exerted on its face by spring means. This latter embodiment, like the former, incorporates a two-way ratchet principle and is likewise subject to the same features and deficiencies inherent in the design of U.S. Pat. No. 2,890,434. After explaining two extremely complex and elaborate embodiments to maintain couplers together, U.S. Pat. No. 4,359,254 discloses and teaches an overly simplistic design for joining backshell assemblies to connector segments, at column 2, lines 49–52 and lines 68–72, a design which provide virtually no means to prevent or inhibit disengagement of the backshell from a connector segment, either by intention or otherwise.

U.S. Pat. No. 3,971,614, in the third, alternate embodiment as shown in FIGS. 18–25 thereof, and in U.S. Pat. No. 4,030,798, there is likewise disclosed the use of a two-way ratchet design, with resilient pawl means. Like the device disclosed in U.S. Pat. No. 2,784,385, the ratchet teeth of U.S. Pat. Nos. 3,971,614 and 4,030,798 extend radially outwardly in respect to the cylindrical axis of the connector. However, the ratchet teeth of these two references are modified such that the teeth face angels, opposed to disassembly of the connector, are greater than the teeth face angles opposed to assembly. Thus, greater torque is required to force the resilient pawls over the teeth, upon disassembly, than is required for assembly. These two references, apparently, only differ in the specific shape of the resilient pawls. Neither of these two references disclose means for connecting backshell assemblies to connector segments. Although the design concept of the devices of these two references seems to, at least partially, overcome the problems, inherent in the designs of the previously mentioned references, of disengagement resistance to jarring, vibration and shock, this design still does not provide any means to resist tampering or otherwise unauthorized disassembly by hand and without tools.

U.S. Pat. No. 4,359,254 discloses a device which, in principle, is a mere variation of the devices taught by U.S. Pat. Nos. 3,971,614 and 4,030,798, with the difference being that U.S. Pat. No. 4,359,254 discloses a design in which both the ratchet teeth and the resilient pawls are formed integrally with the actual bodies of the threadably engageable connector segments. Otherwise, it appears that the device of U.S. Pat. No. 4,359,254 functions in a manner rather like the devices of U.S. Pat. No. 3,971,614 and 4,030,798. U.S. Pat. No. 4,359,254 neither addresses or discloses means for joining backshell assemblies to connector segments.

U.S. Pat. No. 4,703,988 conceptually combines the pawl design of U.S. Pat. No. 2,890,434 with the concept of differential ratchet teeth face angles disclosed in U.S. Pat. Nos. 3,971,614 and 4,030,798. Thus, the device of U.S. Pat. No. 4,703,988 incorporates the simplicity of design of the device of U.S. Pat. No. 2,890,434 with the apparent superior disassembly resistance of U.S. Pat. Nos. 3,971,614 and 4,030,798; nevertheless, all are two-way ratchet designs and, thus, do not incorporate means to prevent disassembly by hand and without tools. U.S. Pat. 4,703,988, like most of the foregoing, does not address or disclose means for joining backshells to connector segments.

The foregoing does not, by any means, exhaust the disclosure of various ratchet designs adapted to electrical connectors. For example, there are various designs in which the pawls themselves are not resilient, but rather are urged into engagement with differing forms of ratchet teeth by separate springs. Such designs are disclosed in U.S. Pat. Nos. 2,728,895; 3,462,727; 3,663,926; 3,808,580; 3,917,373; 4,285,564 and 4,900,260. Some of these designs include complementary ratchet teeth and pawl forms, such as U.S. Pat. Nos. 2,728,895; 3,663,929; 3,917,373; 4,285,564 and 4,900,260; while others incorporate designs where the pawls and corresponding ratchet teeth are in the form of balls and detents, respectively, such as disclosed in U.S. Pat. No. 3,462,727 and 3,808,580. Nevertheless, all of the references mentioned hereinabove in this paragraph disclose devices which can readily be disassembled by hand and without tools, thus none are particularly resistant to tampering and other unauthorized disassembly.

U.S. Pat. No. 2,728,895 discloses four (4) different embodiments of means to mount backshell assemblies to connector segments, only one of which (FIG. 6) can conceivably provide means for inhibiting disengagement thereof, although the text of U.S. Pat. No. 2,728,895 does not teach such; (see column 4, lines 60–64.) U.S. Pat. No. 3,462,727 discloses a "screw-thread 12", conceivably onto which a backshell assembly might be mounted, although such is neither taught or disclosed. U.S. Pat. No. 3,663,926, at the left side of FIG. 1, illustrates a thread which might be used to connect a backshell assembly, however such is neither taught nor disclosed. U.S. Pat. No. 3,808,580 discloses connector shells 12 and 212, with threaded outer surfaces 16 and 216, respectively; this reference, however, teaches that such are "to mount the shell on a bulkhead or other terminal structure"; (see column 2, lines 16–20 and column 3, lines 66–67.) U.S. Pat. No. 3,917,373, in FIG. 1, left side, illustrates a thread on "plug shell 12", but there is no explanation of its purpose. Neither U.S. Pat. No. 4,285,564 nor U.S. Pat. No. 4,900,260 address or disclose means for connecting a backshell assembly to a connector segment.

The present invention seeks to overcome the deficiencies of the devices disclosed by the foregoing references, while maintaining the ability of the electrical connectors to be resistant to being uncoupled by jarring, vibration and shock, as well as resistant to tampering and other unauthorized disassembly. In addition, the present invention provides a new approach to creating an interface between either the connector segment or between a connector segment and a backshell assembly, or both, so as to provide mechanical transition between the electrical connector segments and/or the wiring harnesses to which those electrical connector segments are to be connected. This new approach permits intended field maintenance to, repair of, and/or modification to the cable assembly, the wire leads thereof and the juncture of those wire leads to the male pin assemblies and/or the female receptacle sockets, by facilitating ready disengagement of the connector segments and/or ready disengagement of the backshell assembly from the connector segments to provide access to either the male pin assembly or the female receptacle socket, or both, as well as to the connections thereof to the wire leads of the cables to which the respective connector pins or receptacle sockets are mounted. On the other hand, the indicated new approach also positively prohibits the foregoing when such is not intended. None of the above recited references seem to embody, disclose or discuss such a combination of features nor do any of them seem to disclose such in regard to either connector segments or backshell assemblies, taken as separate items.

BRIEF DESCRIPTION OF THE INVENTION

The present invention comprises a connector segment, e.g., a male coupler or a female socket assembly, adapted to provide an electrical connection between itself and another complementary connector segment, and a backshell means, e.g., a backshell assembly or a tubular backshell such as are adapted to mount an electrical cable to a connector segment, in combination or separately.

The connector segment of the present invention comprises nut means which function to draw the connector segment into full engagement with another complementary connector segment. Also included are ferrule means which function to engage the foregoing other complementary connector segment, thus maintaining the ferrule means rotationally stationary in relation to that other complementary connector segment. Ratchet means, integral with the ferrule means, e.g., ratchet teeth incorporated into the ferrule means or seats incorporated into the ferrule means, are also included. The ratchet means cooperate with resilient pawl means, e.g., a ratchet spring, to function to permit rotation of the nut means in one direction while functioning to prevent rotation of the nut means in the opposite direction. Also included are those resilient pawl means, which function to engage the nut means, e.g., by way of indent projections incorporated into the resilient pawl means, such that the resilient pawl means must rotate with the nut means, e.g., which have incorporated therein detent apertures, when the resilient pawl means are engaged with the nut means, e.g., by insertion of the indent projections into the detent apertures. The resilient pawl means also cooperate with the ratchet means to function to permit rotation of the nut means in one direction and function to prevent rotation of the nut means in the opposite direction, e.g., by engagement of spring fingers, incorporated into the ratchet spring, with the ratchet teeth or seats. Also included are release means, e.g., means by which the indent projections can be pushed out of the detent apertures, which function to permit the resilient pawl means to be disengaged from the nut means such that the nut means is enabled to rotate freely in relation to the resilient pawl means and the ferrule means, thereby disengaging the connector segment, of the present invention, from the other complementary connector segment, but only by application of external tool means, e.g., a spanner wrench, directly to the release means and without damage to either of the connector segments or any parts thereof. Also included are means for readily assembling and disassembling the connector segment by hand with a simple common hand tool, e.g., snap-rung pliers, and without damage to that connector segment. Finally, also included are means for mounting backshell means, e.g., a tubular backshell or a backshell assembly as described in the next paragraph, to the connector segment; those means for mounting function to position the backshell means, in relation to the connector segment, such the portion of the backshell means, which is mounted to the connector segment, is coaxially aligned with an axis of that connector segment and such that such portion of the backshell means is maintained in a given linear position, in relation to that connector segment, as coaxially aligned with an axis of that connector segment.

The backshell assembly of the present invention comprises nut means which function to draw the backshell assembly into full engagement with a connector segment, either that of the present invention or otherwise. Also included are ferrule means which function to engage the foregoing connector segment, thus maintaining the ferrule means rotationally stationary in relation to that connector segment. Ratchet means, integral with the ferrule means, are also included. The ratchet means cooperate with resilient pawl means to function to permit rotation of the nut means in one direction while functioning to prevent rotation of the nut means in the opposite direction. Also included are resilient pawl means which function to engage the nut means such that the resilient pawl means must rotate with the nut means when the resilient pawl means are engaged with the nut means. The resilient pawl means also cooperate with the ratchet means to function to permit rotation of the nut means in one direction and function to prevent rotation of the nut means in the opposite direction. Also included are release means which function to permit the resilient pawl means to be disengaged from the nut means such that the nut means is enabled to rotate freely in relation to the resilient pawl means and the ferrule means, thereby disengaging the backshell assembly from the connector segment, but only by application of external tool means directly to the release means and without damage to the backshell assembly, the connector segment or any part of either or both. Also included are means for readily disassembling the backshell assembly by hand with simple common hand tools and without damage to that backshell assembly. Finally, also included are means for attaching a conduit, e.g., a cable, to the backshell assembly, such means for attaching which function to position the attached portion of that conduit in relation to the backshell assembly such that the attached portion of that conduit is coaxially aligned with an axis of the backshell assembly and such that the attached portion of that conduit is maintained in a given linear position, in relation to that backshell assembly, as coaxially aligned with an axis of that backshell assembly.

As referred to above, the backshell assembly of the present invention may be mounted to the connector segment of the present invention, thus combining both. Alternatively, either the backshell assembly or the connector assembly of the present invention may be used separately. These and other features of the present invention will be more fully explained by the following detailed description, by reference to the accompanying drawings and by study of the claims.

BRIEF DESCRIPTION OF THE DRAWINGS

FIG. 8 is a semi-schematic sectional view of a first embodiment of an indent projection, and a second embodiment of a spring finger, of the second embodiment of the ratchet spring of the present invention as viewed from B—B of FIG. 7.

FIG. 9 is a semi-schematic sectional view of a second embodiment of an indent projection, with a second embodiment of a spring finger, of the second embodiment of the ratchet spring of the present invention as viewed from B—B of FIG. 7.

FIG. 10 is a semi-schematic elevational view of a first embodiment of the ferrule for use in the backshell assembly of the present invention.

FIG. 11 is a semi-schematic plan view of a first embodiment of the ferrule for use in the backshell assembly of the present invention.

FIG. 12 is a semi-schematic elevational view of a second embodiment of the ferrule for use in the backshell assembly of the present invention.

FIG. 13 is a semi-schematic plan view of a second embodiment of the ferrule for use in the backshell assembly of the present invention.

FIG. 14 is a semi-schematic elevational view of a third embodiment of the ferrule for use in the backshell assembly of the present invention.

FIG. 15 is a semi-schematic plan view of a third embodiment of the ferrule for use in the backshell assembly of the present invention.

FIG. 16 is a semi-schematic elevational view of a fourth embodiment of the ferrule for use in the coupler of the present invention.

DETAILED DESCRIPTION

Figure 1:
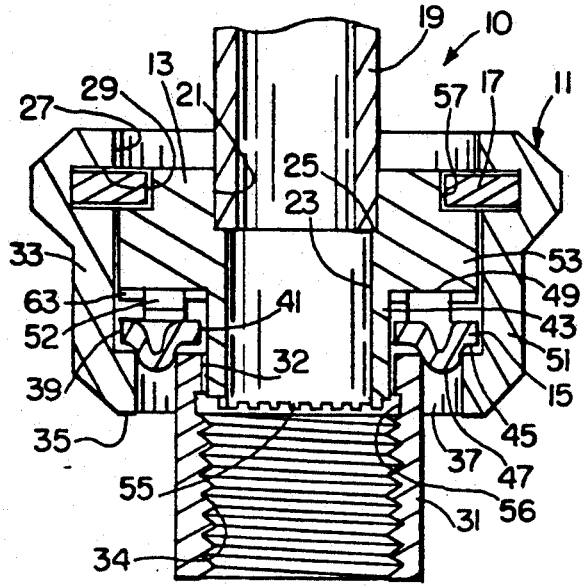
FIG. 1 is a semi-schematic, cut-away elevational view of the backshell assembly of the present invention.
Figure 2:
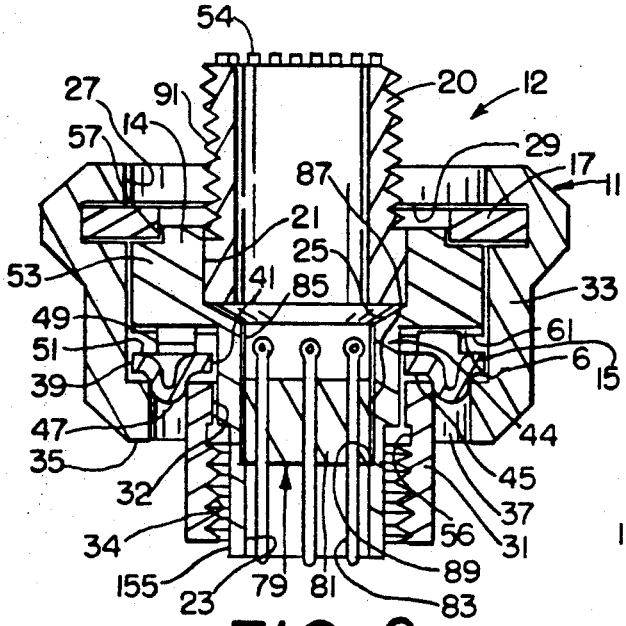
FIG. 2 is a semi-schematic, cut-away elevational view of the coupler of the present invention.

FIG. 1 illustrates the assembly of the elements of the preferred embodiment and presently known best mode of the backshell assembly 10 of the present invention. FIG. 2 illustrates the assembly of the elements of the preferred embodiment and presently known best mode of the coupler 12 of the present invention. Various elements described hereinafter, as well as their respective alternate embodiments, are conceptually and/or structurally adapted to relate to both the backshell assembly 10 and the coupler 12. Also, some of the various elements described hereinafter are conceptually and/or structurally adapted to relate one or more alternate embodiments of other elements, also described hereinafter. Where either of such is the case, each such element (which relates to both the backshell assembly 10 and the coupler 12, and/or which relates to such one or more of such alternate embodiments of other elements) is typically numerically identified with an identical number throughout. It is to be understood that a single description of each such element and/or an embodiment thereof, applies to all other identifications of that element by the identical number, whether only identified additionally by the drawing figures, or only additionally mentioned by reference in the text, or both, and whether or not additional and/or cumulative description thereof is stated.

Referring to FIG. 1 and FIG. 2, fitted internally and concentrically within nut 11 is ferrule 13, ratchet spring 15 and snap ring 17. Backshell housing 19 of the backshell assembly 10 is mounted to ferrule 13 and extends axially outwardly from within nut 11 as shown in the assembly of FIG. 1. Thread extension 20 of coupler 12 is mounted to ferrule 14 and extends axially outwardly from within nut 11 as shown in FIG. 2. Ferrules 13 and 14, which are shown as cut-away in FIG. 1 and FIG. 2, respectively, preferably both include counter-bore 21 axially and concentrically aligned with cylindrical bore 23, also included in both ferrule 13 and ferrule 14; cylindrical bores 23 extend through ferrule 13 and ferrule 14, respectively, and are concentrically aligned with their respective axes of rotation. Counter-bores 21 preferably extend within ferrule 13 and ferrule 14, respectively, to shoulders 25, the predominant surface of which, respectively, are preferably perpendicular to the axes of rotation of ferrule 13 and ferrule 14. In regard to ferrule 13, backshell housing 19 is preferably sized and shaped to fit snugly within counter-bore 21 which, in turn, serves as a corresponding means for mounting backshell housing 19 to ferrule 13. In regard to ferrule 14, thread extension 20 is preferably sized and shaped to fit snugly within counter-bore 21 which, in turn, serves as a corresponding means for mounting thread extension 20 to ferrule 14. Alternatively, ferrule 14 may include, as mounted thereto, backshell housing 19 instead of thread extension 20, depending on the application of coupler 12 as will be well understood by those skilled in the art. Preferably, backshell housing 19 and thread extension 20 are respectively joined together with ferrules 13 and 14 by, for example, furnace brazing, silver soldering or by swaging backshell housing 19 and/or thread extension 20, respectively, into counterbores 21. Alternate means may be employed to join backshell housing 19 to ferrule 13 and either backshell housing 19 or thread extension 20 to ferrule 14, such as, for example, threading the outside circumference of either backshell housing 19 or tread extension 20, or both, to match a corresponding internal threading of either counterbores 21 or cylindrical bores 23 (in the latter case there would be no need for counterbores 21 or shoulders 25, as will be well understood by those skilled in the art.) Further, a composite of ferrule 13 and backshell housing 19, and/or of ferrule 14 and thread extension 20, may be formed as a single piece or element. However, the preferred method of producing ferrules 13 and 14, and backshell housing 19 and thread extension 20, as separate pieces and respectively joining them together, is presently viewed as the most economical. Nevertheless, within the scope of the preferred embodiment of the present invention, all that is required is that ferrule 13 and backshell housing 19 be joined together, and that ferrule 14 and either backshell housing 19 or thread extension 20 be joined together, as described hereinabove, by whatever means are viewed as appropriate in any given circumstance, as will be well understood by those skilled in the art.

Figure 3:
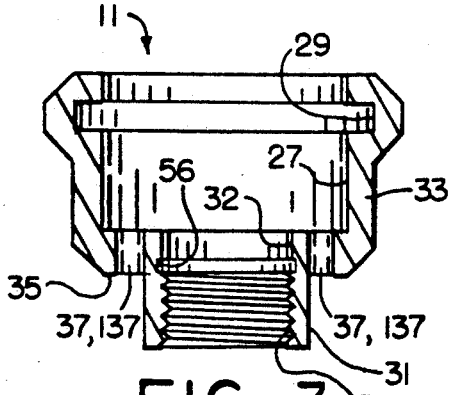
FIG. 3 is a semi-schematic, cut-away elevational view of the nut of either the backshell assembly or the coupler of the present invention.

Referring to FIG. 3, there is shown nut 11, by itself, and without either ferrule 13 or ferrule 14, and without ratchet spring 15 and snap ring 17 installed therein as is the case for FIG. 1 and FIG. 2. Nut 11 includes nut body 33 which, in turn, includes cylindrical recess 27 which is sized to accommodate either ferrule 13 or ferrule 14 and ratchet spring 15, as shown in FIG. 1 and FIG. 2, with a loose fit such that ferrule 13 or ferrule 14 and ratchet spring 15, may readily move or slide in a direction parallel to both of their axes of rotation as well as the concentric axis of rotation of nut 11.

Snap ring groove 29 is formed circumferentially into the internal surface of cylindrical recess 27, with snap ring groove 29 being sized and shaped to accommodate snap ring 17, the design criteria for which are well known to those skilled in the art. Snap ring 17 is a standard, internal snap ring, a shelf item which may be readily purchased from many different sources. It is preferred, however, that snap ring 17 is of the overlapping end type so as to facilitate the sealing off of cylindrical recess 27 from dirt, etc. Likewise, overlapping end type internal snap rings are standard shelf items which may be readily purchased from a wide variety of different sources.

Again referring to FIG. 3, nut extension 31 extends coaxially from nut body 33 and preferably generally comprises a hollow cylindrical section 32 with internal threads 34, being sized to correspond to the external threads of standard female socket assemblies of a pin-type electrical connectors as are well known to those skilled in the art. Thread extension 20 is also preferably sized and externally threaded with external thread 91 to enable engagement with internal thread 34 of nut extension 31. Hollow cylindrical section 32 is larger in diameter than the thread crown of internal threads 34 to accommodate either barrel 43 of ferrules 13, or both barrel 44 and tubular extension 155 of ferrule 14, as is shown respectively in FIG. 1 and FIG. 2, and as will be hereinafter explained.

Nut body 33 and nut extension 31 are joined together by nut shoulder 35; preferably nut 11 is a single piece or element, thus nut extension 31, nut body 33 and nut shoulder 35 are preferably sections of single piece nut 11. Nut body 33 is larger, in both external and internal diameter than the external diameter of nut extension 31, with nut shoulder 35 extending radially to join nut body 33 and nut extension 31 together. The external surface of nut body 33 may have knurling thereabout to facilitate hand (finger) tightening rotation of nut 11 about its axis of rotation.

Figure 20:
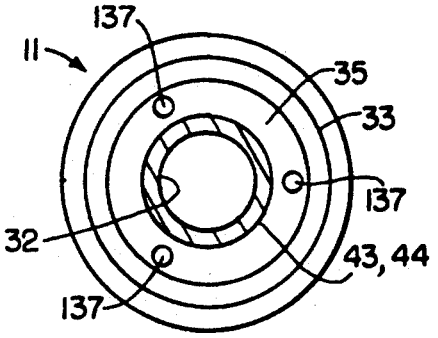
FIG. 20 is a semi-schematic, cut-away plan view of a second embodiment of the nut shoulder of the nut of the present invention.
Figure 19:
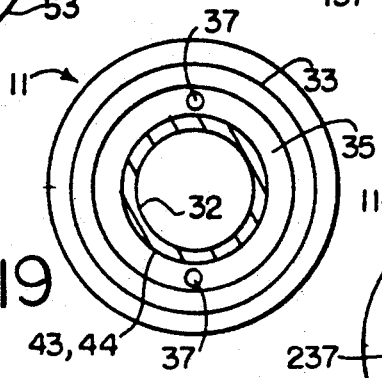
FIG. 19 is a semi-schematic, cut-away plan view of a first embodiment of the nut shoulder of the nut of the present invention.
Figure 21:
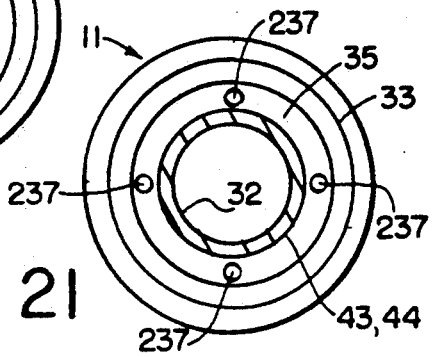
FIG. 21 is a semi-schematic, cut-away plan view of a third embodiment of the nut shoulder of the nut of the present invention.

Again referring to FIG. 3, at least one detent aperture 37 extends through nut shoulder 35; preferably there are two detent apertures 37 as shown in FIG. 1, FIG. 2, FIG. 3 and FIG. 19, however, three detent aperture 137, as shown in FIG. 20, or four detent apertures 237, as shown in FIG. 21, also work well. Detent apertures 37 extend in a direction parallel to the axis of rotation of nut 11 and are positioned radially outwardly from that axis of rotation. It is preferred that no part of detent apertures 37 is closer to the axis of rotation of nut 11 than the outer cylindrical surface of nut extension 31, and no part of detent apertures 37 extends further from the axis of rotation of nut 11 than the inner cylindrical surface of cylindrical recess 27. More preferably, the radially outermost part of detent apertures 37 is located radially inwardly from, and spaced apart, from the internal cylindrical surface of cylindrical recess 27. The purpose and function of detent aperture 37 will be explained hereinafter. It should be noted that nut 11 is used in both the backshell assembly 10 and the coupler 12 of the present invention.

Figure 4:
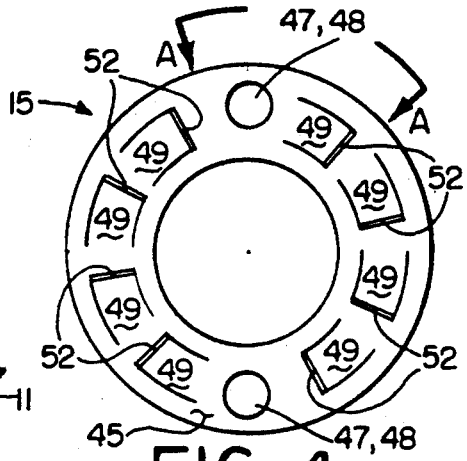
FIG. 4 is a semi-schematic plan view of a first embodiment of the ratchet spring of the either the backshell assembly or coupler of the present invention.
Figure 7:
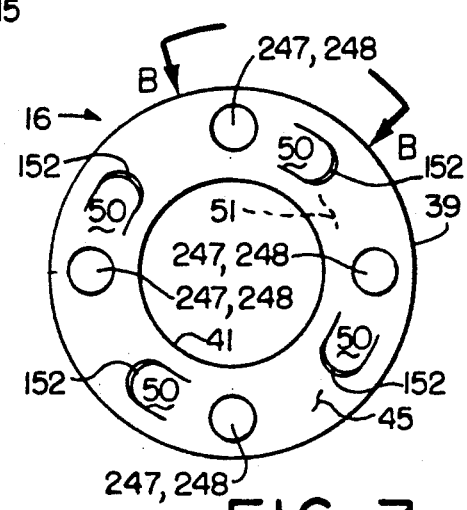
FIG. 7 is a semi-schematic plan view of a second embodiment of the ratchet spring of the either the backshell assembly or coupler of the present invention.

Referring to FIG. 4, there is shown ratchet spring 15 which is the first embodiment of the ratchet spring as used in FIG. 1 and FIG. 2; a second embodiment of the ratchet spring, being ratchet spring 16, is shown in FIG. 7. As the name implies, ratchet springs 15 and 16 are made from a resilient material, preferably a metal such as, for example 17-4-PH ® stainless steel, a product of Armco, Inc., Middletown, Ohio, or AISE No. 410 stainless steel, a generic product which is widely available from many sources. The basic premise of the material used to produce ratchet springs 15 and 16 is that it be capable of being rendered resilient, or "springy", although, as will be readily recognized by those skilled in the art, other considerations may be equally important vis-a-vis the particular application in which backshell assembly 10 and/or coupler 12 of the present invention are to be used.

Ratchet springs 15 and 16 are both generally in the form of washers, being circular flat discs with concentric apertures therethrough. The outside diameter (OD) 39 of ratchet springs 15 and 16 are sized to permit either ratchet spring 15 or 16 to be axially inserted into cylindrical recess 27 of nut body 33 with a loose or slip fit, thus permitting ratchet spring 15 or 16 to freely move in an axial direction within cylindrical recess 27. The inside diameters (ID) 41 of ratchet springs 15 and 16 are sized to permit either ratchet washer 15 or 16 to be axially fitted over barrel 43 of ferrule 13, as shown in FIG. 1, or barrel 44 of ferrule 14 as shown in FIG. 2. The sizing of ID 41 is such that either ratchet spring 15 or 16 may freely move in an axial direction over barrel 43 of ferrule 13, or barrel 44 of ferrule 14, as the case may be.

Figure 5:
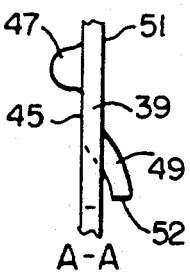
FIG. 5 is a semi-schematic sectional view of a first embodiment of an indent projection, and a first embodiment of a spring finger, of the first embodiment of the ratchet spring of the present invention as viewed from A—A of FIG. 4.
Figure 6:
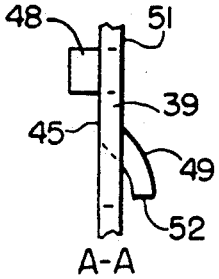
FIG. 6 is a semi-schematic sectional view of a second embodiment of an indent projection, with a first embodiment of a spring finger, of the first embodiment of the ratchet spring of the present invention as viewed from A—A of FIG. 4.

Projecting from the front surface 45 (as shown facing in the plan views of FIG. 4 and (FIG. 7) of ratchet springs 15 and 16 is at least one indent projection 47 or 247, respectively, (a first embodiment) as shown in FIG. 5 and FIG. 8, or at least one indent projection 48 or 148, respectively, (a second embodiment) as shown in FIG. 6 and FIG. 9; preferably, for ratchet spring 15, there are two indent projections 47 or 48 spaced at 180° apart about the arc of the flat circular form of ratchet spring 15 and projecting perpendicularly from front surfaces 45 thereof; preferably, for ratchet spring 16, there are four indent projections 247 or 248 spaced at 90° apart about the arc of the flat circular form of ratchet spring 16 and projecting perpendicularly from front surfaces 45 thereof. In FIG. 5 and FIG. 8, indent projections 47 and 247, respectively, are shown as dimples which can be formed into ratchet springs 15 and 16, for example, by either cold or hot forming as will be well understood by those skilled in the art; this form of indent projection 47 and 247 is preferred for reasons of economy and efficiency of manufacture, with indent projection 47 also shown in both FIG. 1 and FIG. 2 in cut-away, cross-sectional detail. Alternatively, as shown in FIG. 6 and FIG. 9, indent projections 48 and 248 may be in the form of a pins pressed or otherwise mounted into and joined with corresponding apertures formed through ratchet springs 15 and 16, likewise, as will be well understood by those skilled in the art. Indent projections 47 and are formed, located and sized to be readily and freely insertable, respectively, into detent apertures 37 of nut 11, as shown in FIG. 1, FIG. 2 and FIG. 19, when ratchet spring 15 is axially inserted within cylindrical recess 27 of nut body 33. Indent projection 247 and 248 are formed, located and sized to be readily and freely insertable into detent apertures 237 of nut 11, as shown in FIG. 21, when ratchet spring 16 is axially inserted within cylindrical recess 27 of nut body 33 of the embodiment of nut 11 shown in FIG. 21, that embodiment of nut 11 differing only in that it has four detent apertures 237.

Also projecting from the flat circular form of ratchet springs 15 and 16, but from the rear surfaces 51 thereof, are raised spring fingers 49 and 50, respectively, with spring fingers 49 projecting from ratchet spring 15, and with spring fingers 50 projecting from ratchet spring 16. Rear surface 51 is opposite to front surface 45 of ratchet springs 15 and 16, as best shown in FIG. 5, FIG. 6, FIG. 8 and FIG. 9, thus spring fingers 49 and 50 project generally in a direction opposite to that of indent projections 47, 48, 247 and 248. Preferably spring fingers 49 and 50 are integral parts, respectively, of ratchet springs 15 and 16, for economy and efficiency in manufacturing and also to permit greater latitude in the resilient movement of spring fingers 49 and 50. However, spring fingers 49 and/or 50 may be formed as separate pieces and subsequently attached to ratchet springs 15 and/or 16, respectively, e.g., by riveting, spot welding, etc. The preferred embodiments of spring fingers 49 and 50 are formed by punching, from the materials, respectively, of ratchet springs 15 and 16, with the projecting portions of spring fingers 49 and 50 being separated from the respective balance of the materials of ratchet spring 15 and 16, but with the transition junctures, between spring fingers 49 and 50 and respectively ratchet springs 15 and 16, still remaining integrally connected, as shown best in FIG. 5, FIG. 6, FIG. 8 and FIG. 9, but also as shown in FIG. 1, FIG. 2, FIG. 4 and FIG. 7, and as will be well understood by those skilled in the art. Alternatively, the portions of spring fingers 49 and 50, which are respectively separated from ratchet springs 15 and 16, can be formed by electrical discharge machining (EDM), or by application of one or more of a variety of other techniques as are well known to those skilled in the art.

In the development of the first embodiment of the spring fingers, those being spring fingers 49 as shown in FIG. 1, FIG. 2, FIG. 4, FIG. 5 and FIG. 6, the preferably punched and separated section are formed into gentle "S" curves, as shown in FIG. 5 and FIG. 6, extending from rear surface 51 of ratchet spring 15 to project generally in a clockwise direction, as best shown in FIG. 4, for use where internal thread 34, of nut 11, is a right-hand thread and, thus, tightenable by clockwise rotation. The pawl faces 52 of spring fingers 49 preferably extend perpendicular to the general plane of ratchet spring 15, and thus pawl faces 52 extend in a direction opposite to the projection direction of indent projections 47 or 48. Note that in the preferred embodiment of a ratchet spring 15, as shown in FIG. 4, there are eight spring fingers 49 and two indent projections 47, all being generally equidistantly spaced apart from each other. As shown in FIG. 4, indent projections 47 are spaced 180° apart, with two sets of four spring fingers 49 being equidistantly spaced apart along each of the two 180° arcs extending between indent projections 47, as shown in FIG. 3. The purpose and function of this spacing and locational interrelationship, and for such specific number and placement of the spring fingers 49 will be hereinafter explained.

In the development of the second embodiment of the spring fingers, those being spring fingers 50 as shown in FIG. 7, FIG. 8 and FIG. 9, the preferably punched and separated sections are formed as flat sections extending at acute angles, preferably of 30° or less, from the rear surface 51 of ratchet spring 16, as shown in FIG. 8 and FIG. 9, to project generally in a clockwise direction as best shown in FIG. 7, again for use with a right-hand internal thread 34. The pawl faces 152, of spring fingers 50, preferably extend generally perpendicular to the plane of spring fingers 50, thus extending at an obtuse angle to the general plane of ratchet spring 16 and in a direction opposite to, but at and acute angle to, the direction of projection of indent projections 247 and 248. Note that in the preferred embodiment of ratchet spring 16, as shown in FIG. 7, there are four spring fingers 50, and four indent projections 247 or 248 interspaced between the four spring fingers 50. As shown in FIG. 7, indent projections 247 or 248 are spaced 90° apart and spring fingers 50 are also spaced 90° apart. The purpose and function of this spacing and locational interrelationship, and for such specific number and placement of the spring fingers 50 will be hereinafter explained.

Referring to FIG. 10 and FIG. 11, there are shown an elevational view and a plan view, respectively, of ferrule 13. Ferrule 13 is generally in the form of a stepped, hollow cylindrical section and is, preferably, of a relatively hard and wear-resistant metal such as, for example, a ferrous alloy, e.g., stainless steel. Ferrule 13 comprises barrel 43 and flange 53, both of which are hollow cylindrical sections coaxially joined together to form the stepped, hollow cylindrical section of ferrule 13. Barrel 43 extends axially and concentrically from flange 53, with barrel 43 being sized to fit axially, concentrically and freely through ID 41 of ratchet spring 15. Ferrule 13 is designed specifically for use with ratchet spring 15, however, ferrule 13 may also function with ratchet spring 16, as will be well understood by those skilled in the art. Also, the exterior of barrel 43 is diametrically sized to axially, concentrically and freely fit within the hollow cylindrical section 32 of nut extension 31 of nut 11; however the outside diametrical sizing of barrel 43 is greater than the thread crown diameter of internal threads 34 of nut extension 31, thus barrel 43 can only be inserted into nut extension 31 to the point of the transition between hollow cylindrical section 32 and internal threads 34, as shown in FIG. 1.

Ferrule 14, as shown in FIG. 2, differs from ferrule 13 in that teeth 55 of ferrule 13 are replaced by tubular extension 155 of ferrule 14, and in that barrel 43 of ferrule 13 is replace by barrel 44 of ferrule 14; from ratchet shoulder 59 through snap ring stop 57, ferrules 13 and 14 are equivalent. Barrel 44, like barrel 43, extends axially and concentrically from flange 53, with barrel 44 likewise being sized to fit axially, concentrically and freely through ID 41 of ratchet spring 15. Also, the exterior of barrel 44, like barrel 43, is diametrically sized to axially, concentrically and freely fit within the hollow cylindrical section 32 of nut extension 31 of nut 11; however, like barrel 43, the outside diametrical sizing of barrel 44 is greater than the thread crown diameter of internal threads 34 of nut extension 31, thus barrel 44, like barrel 43, can only be inserted into nut extension 31 to the point of the transition between hollow cylindrical section 32 and internal threads 34, as shown in FIG. 2.

As shown in FIG. 10, at the upper end of barrel 43 of ferrule 13, there are axially extending teeth 55 which are sized and shaped to match and mate with corresponding teeth on the backshell end of a standard male coupler of a pin-type electrical connector as will be readily understood by those skilled in the art. Also, teeth 55 of ferrule 13 are sized and shaped to match and mate with corresponding teeth 54 axially extending from thread extension 20, at the upper end thereof as shown in FIG. 2. At the opposite end of ferrule 13, and as well at the same end of ferrule 14, serving as the terminus of flange 53, is snap ring step 57, as shown in FIG. 1 and FIG. 10 at the lower end of ferrule 13 and in FIG. 2 at the lower end of ferrule 14. As shown in FIG. 1 and FIG. 2, snap ring step 57 is complementary, in respect to the internal diameter and a portion of the inner face of snap ring 17, in such a manner that snap ring 17 cannot be compressed and removed from snap ring groove 29 when ferrules 13 and 14 are in the position shown, respectively in FIG. 1 and FIG. 2. However, clearance groove 56, located at the terminus of barrels 43 and 44, adjacent to the transition between hollow cylindrical section 32 and internal threads 34 of nut extension 31 as shown in FIG. 1 and FIG. 2, provides clearance space into which ferrules 13 and 14 can be forced such that snap ring step 57 is sufficiently axially displaced, from the position shown in FIG. 1 and FIG. 2, thus removing the impediment to compressing and either inserting or removing snap ring 17 from snap ring groove 29 to facilitate ready assembly or disassembly of the backshell assembly 10 and the coupler 12 of the present invention, as will be more fully explained hereinafter.

As mentioned above, ferrule 13 is in the form of a stepped, hollow cylindrical section; likewise for ferrule 14. The radial extension of the step comprises ratchet shoulder 59 which generally is positioned perpendicular to the axis of rotation of ferrules 13 and 14. In regard to both ferrules 13 and 14, ratchet teeth 61 extend radially across the plane of ratchet shoulder 59, as best shown in FIG. 11, with ratchet teeth 61 being equidistantly spaced apart from each other. Each of ratchet teeth 61 comprise a cam face 63 and a stop face 65. Each of stop faces 65 is a plane, positioned parallel to the respective axes of rotation of ferrules 13 and 14, extending in a radial direction from barrels 43 and 44 to flange 53. The axial extension of each of stop faces 65 corresponds to the axial extensions of pawl faces 52 of spring fingers 49, as shown in FIG. 1 and FIG. 2.

In the preferred embodiments of ferrules 13 and 14, for use with right-hand internal threads 34 in nut extension 31 of nut 11, stop faces 65 are all arranged to face in a counter-clockwise direction as shown in FIG. 11. Each of ratchet teeth 61 is formed by the protruding intersection (extending upwardly as shown in FIG. 10) of a stop face 65 and a cam face 63, with cam faces 63 forming obtuse angles, in their respective extensions from such intersections thereof with stop faces 65, to extend in a clockwise direction therefrom, again, for use with a right-hand internal thread 34, as depicted in FIG. 11, to the pocket formed (extending downwardly as shown in FIG. 10) at the intersection with the next consecutively positioned stop face in that clockwise direction.

In the first embodiment of the ferrules, ferrule 13 and 14, as shown for ferrule 13 in FIG. 10 and FIG. 11, there are eleven ratchet teeth 61 and, thus eleven axially extending stop faces 65 and eleven of the obtusely angled cam faces 63. This is one more than the number of generally equidistantly spaced apart positions for spring fingers 49, those positions comprising eight actual spring fingers 49 and two positions occupied, instead, by indent projections 47.

The only difference between ferrules 13 and 14, as shown for ferrule 13 in FIG. 10 and FIG. 11, and the second embodiment of the ferrule, ferrule 113 as shown in FIG. 12 and FIG. 13, is that for ferrule 113 there are nine ratchet teeth 61 and, thus nine axially extending stop faces 65 and nine of the obtusely angled cam faces 63. This is one less radial division of ratchet shoulder 59 than the number of generally equidistantly spaced apart positions for spring fingers 49, that number of positions being ten and comprising eight actual spring fingers 49 and two positions occupied, instead, by indent projections 47, as explained previously hereinabove. Ferrule 113 is also specifically designed for use with ratchet spring 15, but like ferrules 13 and 14, could also function with ratchet spring 16.

As arranged in FIG. 1 and FIG. 2, spring fingers 49 project towards ratchet shoulder 59, with spring fingers 49 nesting between stop faces 65 and with spring fingers 49 generally in contact with adjacent cam faces 63. However, because the number of equidistantly spaced apart radial division of ratchet shoulder 59 is greater by one (ferrules 13 and 14), or is less by one (ferrule 113), than the number of equidistantly spaced apart positions for spring fingers 49 on ratchet spring 15, only a single one of pawl faces 52 will be, or can be, in abutting contact with a single one of stop faces 65, at any given point in time, as ratchet spring 15 is rotated in relation to ferrule 13 or 14 about their common axis of rotation as they are arranged in FIG. 1 and FIG. 2. It should be noted that any multiple (including one) of the number of spring finger positions of ratchet spring 15, plus one or minus one, as used respectively for the number of ratchet teeth of ferrule 13 and 113, produces a fine increment of adjustment for tightening of nut 11, i.e., every few degrees of right-hand rotation of nut 11 will produce a discernable (audible and/or by feel) snap of a spring finger 49 over a ratchet tooth 61, dropping a pawl face 52 into abutment with a stop face 65.

When any one of pawl faces 52 is in abutting contact with any one of stop faces 65, as depicted in FIG. 1 and FIG. 2, ratchet spring 15 is prevented from rotating counter-clockwise in relation to either ferrule 13, 14 or 113, about their common axis of rotation, unless ratchet spring 15 and either ferrule 13, 14 or 113 can be moved axially apart and out of contact with each other. However, in the assembly of both of the connector segments 10 and 12, of the present invention, as shown in FIG. 1 and FIG. 2, snap ring 17 prevents ferrules 13 and 14 from moving axially upwardly, while nut shoulder 35 prevents ratchet spring 15 from moving axially downwardly. This also applies to the use of ferrule 113. Thus, on assembly of both the connector segment 10 and 12, of the present invention, as shown in FIG. 1 and FIG. 2, spring fingers 49 are always in contact with cam faces 63.

Also, as shown in FIG. 1 and FIG. 2, indent projections 47 of ratchet spring 15 are seated in corresponding detent apertures 37 of nut shoulder 35 of nut 11. Thus, nut 11 cannot be rotated separately from ratchet spring 15 unless and until indent projections 47 are disengaged from corresponding detent apertures 37. Therefore, in relation to un-threading of right-hand internal thread 34, if ratchet spring 15 cannot be rotated counter-clockwise in relation to ferrule 13, 14 or 113, due to abutment of at least one of pawl faces 52 against at least one of stop faces 65, then likewise, nut 11 cannot be rotated counter-clockwise in relation to ferrule 13, 14 or 113, to un-thread right-hand internal thread 34, unless and until indent projections 47 are axially forced to disengage from detent apertures 37.

Referring to FIG. 14 and FIG. 15, there are shown an elevational view and a plan view, respectively, of ferrule 213. Like ferrules 13, 14 and 113, ferrule 213 is generally in the form of a stepped, hollow cylindrical section and is, preferably, of a relatively hard and wear-resistant metal such as, for example, a ferrous alloy, e.g., stainless steel. Ferrule 213 comprises barrel 43 and flange 53. Barrel 43 extends axially and concentrically from flange 53, with barrel 43 being sized to fit axially, concentrically and freely through ID 41 of ratchet spring 16. Ferrule 213 is designed specifically for use with ratchet spring 16. Also, barrel 43 is diametrically sized to axially, concentrically and freely fit within the hollow cylindrical section 32 of nut extension 31 of nut 11; however the diametrical sizing of barrel 43 is greater than the thread crown diameter of internal threads 34 of nut extension 31, thus barrel 43 can only be inserted into nut extension 31 to the point of the transition between hollow cylindrical section 32 and internal threads 34.

As shown in FIG. 14, at the upper end of barrel 43 of ferrule 213, there are axially extending teeth 55 which are sized and shaped to match and mate with corresponding teeth of a standard male coupler of a pin-type electrical connector as will be readily understood by those skilled in the art. Also, teeth 55 of ferrule 213 are sized and shaped to match and mate with corresponding teeth 54 axially extending from thread extension 20. At the opposite end of ferrule 213, serving as the terminus of flange 53, is snap ring step 57, as shown in FIG. 14 at the lower end of ferrule 213. Snap ring step 57 is complementary, in respect to the internal diameter and a portion of the inner face of snap ring 17, in such a manner that snap ring 17 cannot be compressed and removed from snap ring groove 29 when ferrule 213 is assembled with either the backshell assembly 10 or the coupler 12 of the present invention, as explained hereinabove in regard to ferrule 13 and as illustrated in FIG. 1 and FIG. 2. However, clearance groove 56, located at the terminus of barrel 43 adjacent to the transition between hollow cylindrical section 32 and internal threads 34 of nut extension 31, as explained hereinabove in regard to ferrule 13 and as illustrated in FIG. 1 and in FIG. 2 (in regard to coupler 12), provides clearance space into which ferrule 213 can be forced such that snap ring step 57 is sufficiently axially displaced, thus removing the impediment to compressing and either inserting or removing snap ring 17 from snap ring groove 29 to facilitate ready assembly or disassembly of both backshell 10 and coupler 12, as will be more fully explained hereinafter.

As mentioned above, ferrule 213 is in the form of a stepped, hollow cylindrical section. The radial extension of the step comprises ratchet shoulder 59 which generally is positioned perpendicular to the axis of rotation of ferrule 213. Unlike ferrules 13 and 113, ferrule 213 does not have ratchet teeth 61. Rather, ferrule 213 has seats 261 which are in the form of cylindrical-section shaped apertures axially extending into ratchet shoulder 59 of ferrule 213 in a direction parallel to the axis of rotation of ferrule 213. The diametrical sizing of seats 261 is sufficiently large enough to encompass pawl faces 52 of spring fingers 50 of ratchet spring 16. Seats 261 are equidistantly spaced apart about ratchet shoulder 59 of ferrule 213, their centers lying on a circle which is identical in diameter to a circle drawn through the centers of spring fingers 50 of ratchet spring 16. Referring to FIG. 7, note that a radius, comprising an arc generally of 180° across the plane of each of spring fingers 50, forms each pawl face 152 of spring fingers 50. The sizing of this radius is formed to enable spring fingers 50 to freely drop within seats 261, thus enabling pawl faces 152 of spring fingers 50 to engage the cylindrical surfaces of seats 261. Conceptually, this enables seats 261 to function, in relation to spring fingers 50, as ratchet teeth 61 function in relation to spring fingers 49, as otherwise described herein.

Figure 17:
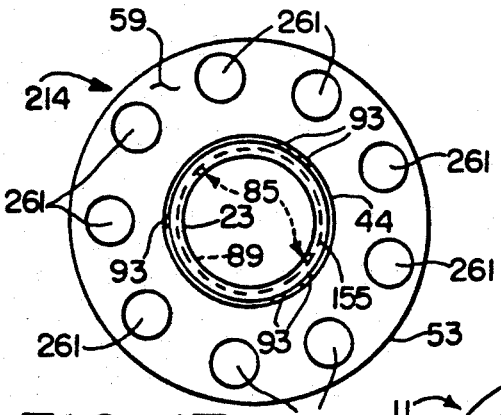
FIG. 17 is a semi-schematic plan view of a fourth embodiment of the ferrule for use in the coupler of the present invention.

Ferrule 14, shown in FIG. 2, differs from the embodiments of ferrules 13, 113 and 213 in three respects. Firstly, as mentioned previously, ferrule 14 does not have teeth 55. Secondly, also as mentioned previously, ferrule 14 has, fixed thereto and extending axially therefrom, tubular extension 155 in place of the teeth 55 of ferrules 13, 113 and 213; tubular extension 155 is an element which is conceptually identical and quite similar in structure to elements commonly found on many standard male couplers, albeit without attachment to ferrule 14. Typically, tubular extension 155 will have external keys 93 extending parallel with the axis of rotation of tubular extension 155, along the outer tubular surface thereof, as is well known to those skilled in the art; external keys 93 are shown in FIG. 16 and FIG. 17. Such external keys 93 are sized and radially positioned to mate with corresponding keyways in complementary elements of standard female socket assemblies (not shown), into which tubular extension 155 is diametrically sized to also be fitted. Various alternative concepts of means to fit male couplers to female socket assemblies are shown in the references discussed hereinabove, several of which could readily be adapted to or incorporated into tubular extension 155, as will be apparent to those skilled in the art; such are within the scope of the present invention.

Also, as will be quite apparent to those skilled in the art, the male coupler 12 of the present invention could readily be modified to serve as a female socket assembly, to be connected to a standard male coupler as is also well known to those skilled in the art; such is within the scope of the present invention. Where such is the case, tubular extension 155 would be modified to become what has heretofore been described, in the preceding paragraph, as "those elements of the standard female socket assembly which are complementary to tubular extension 155". In such a case, modified tubular extension 155 (not shown) would not have external keys 93, but rather would have complementary keyways (not shown) extending parallel to the axis of rotation of modified tubular extension 155 along the inner tubular surface thereof, those complementary keyways being sized and radially positioned to mate with corresponding external keys, essentially identical to external keys 93, of a standard male coupler, over which modified tubular extension 155 would be diametrically sized to be fitted.

The third difference, between ferrule 14, on the one hand, and ferrules 13, 113 and 213, on the other hand, is that ferrule 14 is specifically designed to be a ferrule for coupler 12, as distinguished from a ferrule for a backshell assembly 10. Referring to FIG. 2, note that ferrule 14 has coaxially inserted, within the inside diameter of barrel 44, disc assembly 79, comprising disc 81, of an electrically insulating material, and at least one contact pin 83, preferably a plurality of contact pins 83, spaced apart from each other and/or from the inside diameter of barrel 44, and inserted through disc 81 as shown in FIG. 2; contact pins 83 are of an electrically conductive material. Alternatively, disc 81, where used as a female socket, would have tubular members (not shown), corresponding to and complementary with the contact pins of a standard male coupler; those tubular member should be electrically conductive, and would provide sockets into which the contact pins of a standard male coupler would be insertable, as will be well understood by those skilled in the art.

Preferably, within ferrule 14, there are two raised keys 85 which extend, parallel to the axis of rotation of ferrule 14, along the inside diametrical surface of barrel 44 (this distinguishes barrel 44 from barrel 43), with raised keys 85 preferably being radially spaced apart about that surface by 180°. Raised keys 85 correspond to keyways 87 which extend along the exterior cylindrical surface of disc 81, such that when disc 81 is in place, as shown in FIG. 2, within the inside diameter of barrel 44, disc 81 is prevented from rotating by virtue of the interlocking of raised keys 85 and keyways 87, as will be well understood by those skilled in the art. Otherwise, the fit between disc 81 and inside diameter of barrel 44 is preferably a slip fit, thus permitting disc 81 to be readily slipped into and out of the inside diameter of barrel 44 for ease of assembly and access thereafter.

On assembly, disc 81 is advanced through the inside diameter of barrel 44 towards tubular extension 155, where disc 81 comes into abutment with disc stop shoulder 89, comprising a step-down of the diametrical sizing either of the inside diameter of barrel 44, or as shown in FIGS. 2, of the internal diameter of tubular extension 155. Disc stop shoulder 89 prevents disc 81 from being further advanced, thus maintaining disc 81 axially within ferrule 14 in respect to further movement downwardly as shown in FIG. 2.

On engagement of the male coupler 12 of the present invention, to a standard female socket assembly of a pin-type electrical connector, initially, tubular extension 155 and external keys 93 engage corresponding elements of the female socket assembly. The standard female socket assembly is usually maintained rotationally stationary in relation to the corresponding male coupler 12, i.e., the corresponding male coupler 12 normally must be rotated to fully threadably engage it with the standard female socket assembly; thus conceptually, the coupler 12, as well as the backshell assembly 10 (in regard to the backshell end of either a standard male coupler or a standard female socket assembly), of the present invention will be hereinafter explained with the assumption that the foregoing is fact, although those skilled in the art will easily recognize that the converse could be the case.

The engagement, between tubular extension 155 and external keys 93 of coupler 12 with the corresponding elements of the standard female socket assembly, by virtue of their respective keys 93 and corresponding keyways being engaged, and the axial insertion of tubular extension 155 to within a correspondingly relatively closely fitting element of the standard female socket assembly, to rotationally stationarily position them together, serves to maintain ferrule 14 in position, rotationally aligned with the standard female socket assembly. Predominantly, standard female socket assemblies have external right-hand threads which correspond to the internal threads of nut body 33 which, as shown in FIG. 2 and FIG. 3, likewise are right-hand threads. Thus, following the engagement of tubular extension 155 and external keys 93 with the corresponding elements of the standard female socket assembly, nut 11 is rotated in a clockwise direction, as viewed by looking from top to bottom of FIG. 2, to threadably engage right-hand internal threads 34 with the right-hand external male threads of the female socket assembly; this draws nut 11 axially onto the standard female socket assembly and tends to force ferrule 14 in an axial direction against snap ring 17. The clockwise rotation of nut 11, as it is threaded and drawn onto the right-hand external of the standard female socket assembly, for example, causes spring fingers 49, which are resilient, to flexurally drag across cam faces 63, which are maintained rotationally stationary due to ferrule 14 being held rotationally stationary by the engagement of tubular extension 155 with the corresponding element of the standard female socket assembly.

In regard to coupler 12, each of spring fingers 49 rides along an angled cam face 63 until it reaches the protruding intersection thereof with a stop face 65, as serves to define a ratchet tooth 61. As spring finger 49 is dragged past such intersection, spring finger 49 resiliently flexes to discernably snap its pawl face 52 into abutting engagement with immediately adjacent stop face 65. As previously explained, the abutting engagement, of at least one of pawl faces 52 with at least one of stop faces 65, prevents counter-clockwise rotation of nut 11, thus preventing disengagement, or un-threading, of right-hand internal threads 34 from the right-hand external male threads of the standard female socket assembly; this is due to the engagement of tubular extension 155 and external keys 93 with the corresponding elements of that standard female socket assembly which prevent ferrule 14 from rotating independently in relation to that standard female socket assembly.

As will be well understood by those skilled in the art, ferrule 14 may be readily modified and adapted to incorporate the differing features of flange 53 of ferrule 213, to thus produce ferrule 214 as shown in FIG. 16 and FIG. 17, thus also using ratchet spring 16 in place of ratchet spring 15 in the assembly of coupler 12. In such an arrangement, following the engagement of tubular extension 155 and the external keys 93 with the corresponding elements of the standard female socket assembly, nut 11 is rotated in a clockwise direction, as viewed by looking from top to bottom of FIG. 2, to threadably engage right-hand internal threads 34 with the right-hand external male threads of the female socket assembly; this draws nut 11 axially onto the standard female socket assembly and tends to force ferrule 214 in an axial direction against snap ring 17.

In regard to ferrule 214, the clockwise rotation of nut 11 of coupler 12, as it is threaded and drawn onto the right-hand external threads of the standard female socket assembly, for example, causes spring fingers 50, which are resilient, to flexurally drag across the adjacent intersections of seats 261 with ratchet shoulder 59 of flange 53 of ferrule 214, which incorporate the features of flange 53 of ferrule 213; seats 261 are rotationally stationary due to ferrule 214 being held rotationally stationary by virtue of the engagement of tubular extension 155 and external keys 93 with the corresponding elements of the standard female socket assembly. Each of spring fingers 50 rides along the surface of ratchet shoulder 59 of flange 53 of ferrule 214 until it reaches the next succeeding seat 261. As each of spring finger 50 is dragged into alignment with a next succeeding seat 261, that spring finger 50 resiliently flexes to discernably snap it into that next succeeding seat 261, with the edge or surface of the pawl face 152 of that spring finger 50 coming into abutting engagement with the immediately adjacent cylindrical surface of seat 261. The abutting engagement, of the edge or the surface of at least one of pawl faces 152 of spring fingers 50, with at least one of the cylindrical surfaces of seats 261, prevents counter-clockwise rotation of nut 11, thus preventing disengagement, or un-threading, of right-hand internal threads 34 from the right-hand external male threads of the standard female socket assembly; this is due to the engagement of tubular extension 155 and external keys 93 with the corresponding elements of that standard female socket assembly which prevent ferrule 214 from rotating independently in relation to that standard female socket assembly.

As noted above, ratchet spring 16 is radially divided into four spring fingers 50, equidistantly spaced apart, with four indent projections 247 or 248, also equidistantly spaced 90° apart and interspersed between the four spring fingers 50. Note that this comprises only four equidistantly spaced apart positions for spring fingers 50, all of which are actual spring fingers 50, with none of those positions being occupied by indent projections 247 or 248. Ferrule 214, shown in FIG. 16 and FIG. 17, like ferrule 213 as shown in FIG. 14 and FIG. 15, has nine seats 261 equidistantly space apart in a circle around ratchet shoulder 59. The number of seats is one more than twice the number of positions of spring fingers 50 of ratchet spring 16. Because the number of equidistantly spaced apart radial division of ratchet shoulder 59 is greater by one, than double the number of equidistantly spaced apart positions for spring fingers 50 on ratchet spring 16, only a single one of pawl faces 152 will be, or can be, in abutting contact with a single one of the cylindrical surfaces of seats 261, at any given point in time, as ratchet spring 16 is rotated in relation to either ferrule 214 or ferrule 213, about their common axes of rotation. It should be noted that any multiple (including one) of the number of spring finger positions of ratchet spring 16, plus one or minus one, as used respectively for the number of ratchet teeth of ferrule 214 and 213, produces a fine increment of adjustment for tightening of nut 11, i.e., every few degrees of right-hand rotation of nut 11 will produce a discernable snap of a spring finger 50 into a seat 261, dropping a pawl face 152 into abutment or contact with a cylindrical surface of a seat 261.

As previously mentioned, teeth 55 of ferrules 13, 113 and 213 are sized and shaped to be engaged with teeth 54 of thread extension 20, as well as with corresponding teeth of the backshell end of a standard male coupler or a standard female socket assembly. Also, as inferred previously, internal threads 34 of nut 11 can be threadably engaged with external threads 91 of thread extension 20 of coupler 12. Thus, backshell assembly 10, as shown in FIG. 1, can be threaded onto thread extension 20 of coupler 12 as shown in FIG. 2, thus joining backshell assembly 10 to coupler 12; also, backshell assembly 10 can, in the same manner, be threaded onto the backshell end of a standard male coupler, which is essentially the same as thread extension 20 of coupler 10 (or the backshell end of a standard female socket assembly which is, likewise, essentially the same as thread extension 20 of coupler 10). As nut 11 of backshell assembly 10 is threaded onto thread extension 20 of coupler 12, teeth 55 of ferrule 13, 113 or 213 are drawn into mating engagement with teeth 54 of thread extension 20, thus rendering ferrule 13, 113 or 213 incapable of rotating separately from thread extension 20 of coupler 12. Conceptually, but not structurally, this is the same situation and circumstance, explained previously, in regard to tubular extension 155 and external keys 93 becoming engaged with a corresponding elements of a standard female socket assembly, i.e., neither can rotate independently from the other. At the point where teeth 54 and 55 begin to become matingly engaged, further rotation of nut 11, as it is further threaded and drawn onto right-hand thread extension 20 causes, for example, spring fingers 49, which are resilient, to flexurally drag across cam faces 63, which are rotationally stationary due to ferrule 14 or 214 being held rotationally stationary by the mating engagement of teeth 54 and 55.

In regard to backshell assembly 10, vis-a-vis the preceding paragraph, each of spring fingers 49 rides along an angled cam face 63 until it reaches the protruding intersection thereof with a stop face 65, as serves to define a ratchet tooth 61. As each spring finger 49 is dragged past such an intersection, that spring finger 49 resiliently flexes to discernably snap its pawl face 52 into abutting engagement with the immediately adjacent stop face 65. As explained, where internal thread 34 is right-hand thread, the abutting engagement, of at least one of pawl faces 52 with at least one of stop faces 65, prevents counter-clockwise rotation of nut 11, thus preventing disengagement, or un-threading, of right-hand internal threads 34 from right-hand external male threads 91 of thread extension 20, thus preventing ferrule 13 or 113 from rotating independently in relation to thread extension 20.

As will be well understood by those skilled in the art, ferrule 213 may be used in place of ferrules 13 and 113, thus also calling for use of ratchet spring 16 in place of ratchet spring 15 in the assembly of backshell assembly 10. In such an arrangement, following the mating engagement of teeth 54 and 55, where internal thread 34 is a right-hand thread, nut 11 is rotated in a clockwise direction, as viewed by looking from top to bottom of FIG. 1, to threadably engage right-hand internal threads 34 with right-hand external male threads 91 of thread extension 20; this draws nut 11 axially onto coupler 12 and tends to force ferrule 213 in an axial direction against snap ring 17.

In regard to backshell 10, vis-a-vis the preceding paragraph, the clockwise rotation of nut 11, as it is threaded and drawn onto coupler 12, causes, for example, spring fingers 50, which are resilient, to flexurally drag across the adjacent intersections of seats 261 with ratchet shoulder 59 of flange 53 of ferrule 213; seats 261 are rotationally stationary due to ferrule 213 being held rotationally stationary by the mating engagement of teeth 54 and 55. Each of spring fingers 50 rides along the surface of ratchet shoulder 59 of flange 53 of ferrule 213 until it reaches the next succeeding seat 261. As each of spring finger 50 is dragged into alignment with a next succeeding seat 261, that spring finger 50 resiliently flexes to discernably snap itself into that next succeeding seat 261, with the edge or surface of the pawl face 152 of that spring finger 50 coming into abutting engagement with the immediately adjacent cylindrical surface of seat 261. As explained, where internal thread 34 is a right-hand thread, the abutting engagement, of the edge or the surface of at least one of pawl faces 152 of spring fingers 50, with at least one of the cylindrical surfaces of seats 261, prevents counter-clockwise rotation of nut 11, thus preventing disengagement, or un-threading, of right-hand internal threads 34 from right-hand external male threads 91 of thread extension 20; this is due to the mating engagement of teeth 54 and 55 which prevent ferrule 213 from rotating independently in relation to thread extension 20 of coupler 12.

Figure 18:
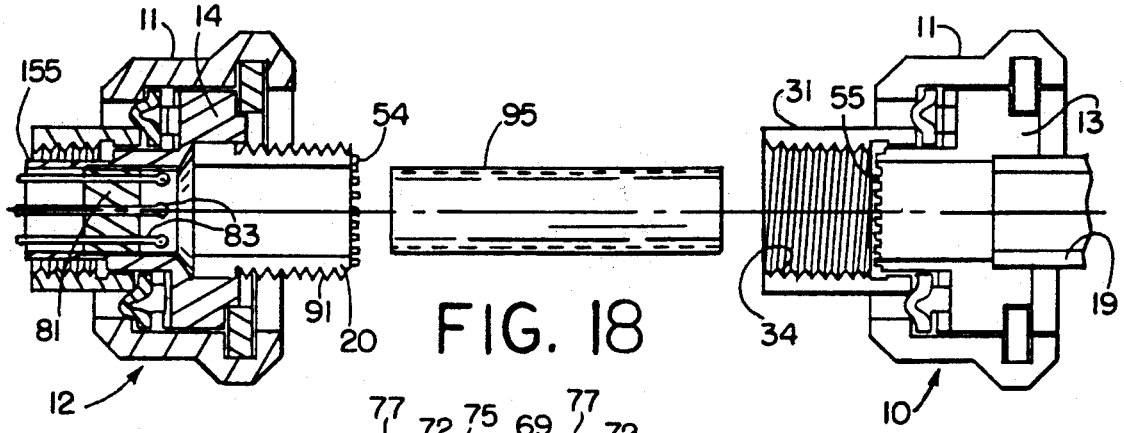
FIG. 18 is a semi-schematic, exploded elevational view of an assembly of the backshell assembly and the coupler of the present invention.

Referring to FIG. 18, there is shown an exploded view of the preferred manner of engaging backshell assembly 10 to coupler 12. Note that preferably insulator tube 95 appears interposed between backshell assembly 10 and coupler 12 as shown in FIG. 18. Preferably, insulator tube 95 is diametrically sized to slip fit within cylindrical bore 23 of ferrule 14, just clearing raised keys 85 thereof, such that insulator tube 95 abuts disc 81 and serves to separate that adjacent portions of contact pins 83 from raised keys 85 and cylindrical bore 23. The material used to produce insulator tube 95 is selected for its electrical insulation properties as well as its physical properties, i.e., preferably a material with a relatively high dielectric constant and sufficient mechanical properties to permit use as a means to maintain disc assembly 79 in position against disc stop shoulder 89 as contact pins 83 are inserted into corresponding female sockets (or the converse if disc 81 is to comprise a female socket assembly). Examples of acceptable materials are high density polyethylenes, polypropylenes and PTEE fluorocarbons, all of which are well known to those skilled in the art as having the preferred properties.

As illustrated in FIG. 18, the end of insulator tube 95, opposite from the end thereof which is to abut disc assembly 79, is insertable into cylindrical bore 23 of ferrule 13, from that end of ferrule 13 where teeth 55 are located, to abut backshell housing 19. The length of insulator tube 95 is preferably such that, when teeth 54 and 55 are fully matingly engaged, the respective ends of insulator tube 95 are in contact with disc assembly 79 and backshell housing 19. Thus, insulator tube 95 is sized to provide a positive stop to prevent disc assembly 79 from being pushed away from disc stop shoulder 89 as linear force is applied against the opposite end of disc assembly 79.

Alternatively, there are various other means, well known to those skilled in the art, for maintaining disc assembly 79 in position within cylindrical bore 23 and/or the inside diameter of tubular extension 155; some of those means may be such that insulator tube 95, raised keys 85 and/or disc stop shoulder 89 may be eliminated. Within the scope of the preferred embodiment of the coupler 12 of the present invention, all that is functionally required are means for maintaining disc 81 in position within cylindrical bore 23 and/or the inside diameter of tubular extension 155.

Figure 25:
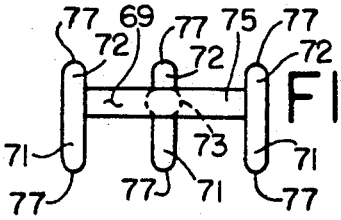
FIG. 25 is a semi-schematic elevational view of a second embodiment of the spanner wrench for use in relation to the nut of the present invention.

In regard to backshell assembly 10, to disengage, or un-thread, right-hand internal threads 34 (from right-hand external threads 91 of thread extension 20 of coupler 12 or from the backshell end of either a standard male coupler or a standard female socket assembly), nut 11 of backshell assembly 10 must be disengaged from ratchet spring 15 or 16, thus permitting nut 11 to be rotated in a counter-clockwise direction. This is accomplished by depressing indent projections 47 and 48 from within detent apertures 37, 137 or 237, the necessity for which is not readily apparent when backshell 10 of the present invention is viewed by persons not specifically trained in its function and/or intimately familiar with its design. Backshell 10 of the present invention cannot readily be disengaged from the coupler 12 of the present invention, or from the backshell end of either a standard male coupler or a standard female socket assembly to which it has been engaged in the manner explained hereinabove, without either destroying both, or using a single specific tool which, in a first embodiment, is illustrated in FIG. 22 and FIG. 23, and, in a second embodiment, is illustrated in FIG. 24 and FIG. 25.

In regard to coupler 12, to disengage, or un-thread, right-hand internal threads 34 from right-hand external threads of, for example, a standard female socket assembly, nut 11 of coupler 12 must be disengaged from ratchet spring 15 or 16, thus permitting nut 11 to be rotated in a counter-clockwise direction. This is accomplished by depressing indent projections 47 or 48 from within detent apertures 37, 137 or 237, the necessity for which is not readily apparent when the coupler 12 of the present invention is viewed by persons not specifically trained in its function and/or intimately familiar with its design. Coupler 12 of the present invention cannot readily be disengaged from a standard female socket assembly (or from a standard male coupler assembly, as the case may be) without either destroying both, or using a single specific tool which, as mentioned above, in a first embodiment, is illustrated in FIG. 22 and FIG. 23, and, in a second embodiment, is illustrated in FIG. 24 and FIG. 25.

Figure 22:
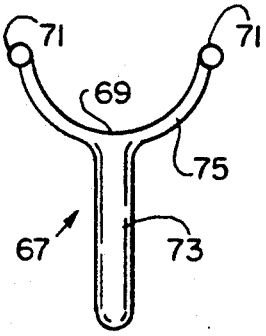
FIG. 22 is a semi-schematic plan view of a first embodiment of the spanner wrench for use in relation to the nut of the present invention.
Figure 23:
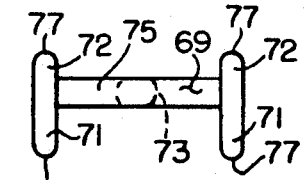
FIG. 23 is a semi-schematic elevational view of a first embodiment of the spanner wrench for use in relation to the nut of the present invention.
Figure 24:
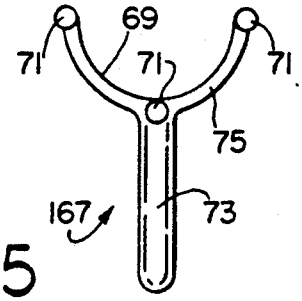
FIG. 24 is a semi-schematic plan view of a second embodiment of the spanner wrench for use in relation to the nut of the present invention.

The first embodiment of a spanner wrench, being spanner wrench 67, is shown in FIG. 22 and FIG. 23. The internal are 69 of spanner wrench 67 is sized to generally half surround nut extension 31 to the extend of about a 180° arc, and when placed in such a relationship to nut extension 31, the two lugs 71 of spanner wrench 67 are axially aligned with the two detent apertures 37, shown in FIG. 19, of nut shoulder 35. The length of lugs 71 is such that insertion thereof fully into detent apertures 37 will push indent projections 47 or 48 fully to within cylindrical recess 27 and out of detent apertures 37, thus disengaging ratchet spring 15 or 16 from nut shoulder 35. Lugs 71 project perpendicularly from the general plane of spanner wrench 67, with lugs 71 being aligned parallel to the axis of rotation of internal arc 69; lugs 71 both project in the same direction away from the plane of spanner wrench 67 as is best shown in FIG. 23. Lugs 72 are extensions of lugs 71, extending in the opposite direction from the extensions of lugs 71. The length of extension of lugs 72, however, is not as great as for lugs 71, with lugs 72 merely being long enough to engage detent aperture 37 or 237 to enable turning, or rotation, of nut 11, but not sufficiently long enough to extend to cylindrical recess 27 or to a point where lugs 72 would begin to push indent projections 47 or 48 out of their fully seated position within detent apertures 37 or 237. Preferably, spanner wrench 67 is to be used in the embodiment of nut 11 shown in FIG. 19 as having two detent apertures 37 spaced 180° apart, although spanner wrench 67 may also be used with the embodiment of nut 11 shown in FIG. 21 as having four detent aperture 237 spaced 90° apart, that embodiment of nut 11 shown in FIG. 21 corresponding to the four indent projections 247 or 248 of the preferred embodiment of ratchet spring 16.

The body of spanner wrench 67 comprises a handle 73 which extends radially from arc section 75; arc section 75 is the structure surrounding internal arc 69, as will be well understood by those skilled in the art. Lugs 71 and 72 may be integral with spanner wrench 67 or mounted and fixed thereto by, for example, welding or brazing. Lugs 71 and 72 are shown in FIG. 23 with hemispherical crowns 77 at the remote ends thereof to facilitate entry of lugs 71 or 72 into detent apertures 37 (or detent apertures 237), as will be well understood by those skilled in the art.

Disengagement of backshell 10 from the backshell end of either a standard male coupler or a standard female socket assembly, or from thread extension 20, or the disengagement of coupler 12 from a standard female socket assembly, is accomplished by placing the internal arc 69 of spanner wrench 67 in position to surround nut extension 31, with the projections of lugs 71 pointed towards detent apertures 37 or 237. The spanner wrench is moved laterally along the axis of rotation of nut extension 31 so as to insert lugs 71 to fully within corresponding detent apertures 37 or 237, thus forcing indent projections 47 or 48 completely out of detent apertures 37 or 237 to within cylindrical recess 27 of nut body 33. Because ratchet spring 15 is of resilient material, the forcing of indent projections 47 or 48 fully out of detent apertures 37 or 237 is readily accomplished by the flexure of spring fingers 49 or 50 against cam faces 63 of ferrule 13, 14 or 113, or ratchet shoulder 59 of ferrule 213 or 214, as the case may be. With indent projections 47 or 48 fully pushed out of, and removed from, detent aperture 37 or 237, spanner wrench 67 is turned such that nut 11 is rotated in a counter-clockwise direction until right-hand internal threads 34 become sufficiently disengaged, from the external right-hand threads of, for example, the standard female socket assembly with which coupler 12 of the present invention had been fully engaged, such that ratchet spring 15 or 16 is loose within cylindrically recess 27. Then spanner wrench 67 is removed and turned around, 180°, such that lugs 72 can be inserted into detent apertures 47 or 48 to continue the un-threading of nut 11; the shorter length of lugs 72 prevents any possibility of entanglement of now loose ratchet spring 15 or 16 with lugs 71. (Also, the shorter lugs 72 may be used to tighten nut 11 while indent projections 47 or 48 are fully seated within detent apertures 37 or 237.) Then, tubular extension 155 and external keys 95 of coupler 12 can be readily separated from the corresponding elements of the standard female socket assembly by simply axially pulling coupler 12 away from that standard female socket assembly to disengage the contact pins 83 therefrom. For backshell assembly 10, teeth 55 can simply be axially pulled away from corresponding teeth 54 of thread extension 20, to separate backshell assembly 10 from coupler 12, or from the backshell end of either a standard male coupler or a standard female socket assembly.

Referring to FIG. 21, the second embodiment is spanner wrench 167 which is very similar to spanner wrench 67, the difference being that a third set of lugs 71 and 72 are added mid-point along internal arc 69, adjacent to the juncture of handle 73 with arc section 75. Spanner wrench 167 is specifically designed for use with the embodiment of nut 11 shown in FIG. 21 which has four detent apertures 237 therein. Spanner wrench 167, having three sets of lugs 71 and 72, is better able to ensure that all four of indent projections 47 or 48 of ratchet spring 50 will be depressed to within cylindrical recess 27 for un-threading of either backshell assembly 10 or coupler 12. This is especially useful where backshell assembly 10 or coupler 12 are of a relatively smaller or miniature size, and wherein ratchet spring 16 is of a lighter gage of metal, thus enhancing the tendency thereof to warp, or deform to produce a wave form, when widely spaced apart points of force are applied thereto parallel to the axis of rotation thereof, i.e., spanner wrench 167 engages three of the four indent projections 49 or 50 of ratchet spring 16, rather than only two of those four indent projections 49 or 50 where spanner wrench 67 is used; thus use of spanner wrench 167 in such circumstances tends to significantly diminish such warp or deformation, as will be well understood by those skilled in the art.

There is yet a third embodiment of the spanner wrench of the present invention (not shown) which is specifically adapted to function with the embodiment of nut 11 shown in FIG. 20 which has three detent apertures 137. This third embodiment is similar to spanner wrench 167, the difference being that internal arc 69 is extended to 240°, thus rendering it capable of two-thirds surrounding nut extension 31. The lug sets 71 and 72 are positioned such that a set is located at each of the two extremes of the arc, with the third set being positioned identical to that of spanner wrench 167; thus, the three sets of lugs 71 and 72 are aligned with all three of detent apertures 137 as shown in FIG. 20.

To this point, substantially all of the description regarding the threading and un-threading of internal threads 34 has been with the understanding that internal threads 34 are right-hand threads. On the other hand, internal threads 34, within the scope of the present invention, may be left-hand threads, requiring threading by counter-clockwise rotation and un-threading by clockwise rotation. In such circumstances, spring fingers 49 and 50 would circumferentially extend, in a counter-clockwise direction, from, respectively, ratchet springs 15 and 16, i.e., the corresponding modified ratchet springs 15 and 16 would be the mirror image of those shown in FIG. 4 and FIG. 7, with spring fingers 49 and 50 extending opposite in direction to those shown in FIG. 1, FIG. 2, FIG. 5, FIG. 6, FIG. 8 and FIG. 9. Also, in such circumstances, cam faces 63 of ferrules 13, 14 and 113 would slop in the opposite direction from those shown in FIG. 1, FIG. 2, FIG. 10 and FIG. 12, with so modified ferrules 13, 14 and 113 being the mirror images of those shown in FIG. 10 and FIG. 12. On the other hand, in such circumstances, ferrules 213 and 214 would remain unchanged. Finally, in such circumstance, all references, prior to this paragraph, to clockwise would change to counter-clockwise, and to counter-clockwise would change to clockwise, while all references to right-hand would change to left-hand. With these changes, both the structure and function of the present invention are defined as adapted to left-hand internal threads 34 and left-hand external threads 91.

Assembly of either the backshell assembly 10 or the coupler 12 of the present invention is accomplished by first expanding snap ring 17, with standard snap ring pliers, to fit snap ring 17 axially over flange 53, of ferrule 13, 14, 113, 213 or 214, to a point beyond snap ring step 57. Then ratchet spring 15 or 16 is axially inserted to within cylindrical recess 27 of nut body 33 to a point adjacent nut shoulder 35. This is followed by the rotational manipulation of ratchet spring 15 or 16 so that indent projections 47, 48, 247 or 248 become seated, respectively, fully within detent apertures 37, 137 or 237, as the case may be. Next ferrule 13, 113 or 213, with backshell housing 19 attached, or ferrule 14 or 214, with either thread extension 20 or backshell housing 19 attached, is axially inserted into cylindrical recess 27 until contact is made between spring fingers 49 and cam faces 63 or between spring fingers 50 and the surface of ratchet shoulder 59 of ferrule 213 or 214, as the case may be. The snap ring 17 is contracted, or compressed, normally with standard snap ring pliers, and inserted axially in the compressed disposition into cylindrical recess 27 until snap ring 17 abuts ferrule 13, 14, 113, 213 or 214. Then axial force is applied to the snap ring pliers, thus forcing snap ring 17 and ferrule 13, 14, 113, 213 or 214 axially further within cylindrical recess 27, causing spring fingers 49 of ratchet spring 15, or spring fingers 50 of ratchet spring 16, to flex. At the point where ferrule 13, 14, 113, 213 or 214 is forced axially beyond snap ring groove 29, snap ring 17 will expand to within snap ring groove 29, causing the inner diameter of snap ring 17 to expand to a size greater than snap ring step 57 of ferrule 13 and, thus, permitting ferrule 13, 14, 113, 213 or 214 to move axially within cylindrical recess 27 such that snap ring step 57 is within snap ring 17. Now, snap ring 17 can no longer be compressed, as snap ring step 57 serves as a block thereto. However, this block can be readily removed, simply by forcing ferrule 13, 14, 113, 213 or 214 towards nut shoulder 35, for example, with the tips of standard snap ring pliers, thereby flexing spring fingers 49 or 50. Once this is accomplished, snap ring 17 may be compressed, again with standard snap ring pliers, and either the backshell assembly 10 or the coupler 12 of the present invention can be readily disassembled in the field to provide access to ferrule 13, 113 or 213 and backshell housing 19, or to ferrule 14 or 214 and either backshell housing 19 or thread extension 20, for electrical connector and/or cable maintenance, repairs and/or modifications.

Although the present invention is described variously throughout in terms of an "electrical connector" (singular or plural) and/or in terms of an "electrical connection" (singular or plural), it will be readily be understood by those skilled in the art that the present invention could equally well apply to optical fiber connectors, hydraulic connectors and pneumatic connectors, and their respective connections. Thus, as used herein, the term "electrical connector", either singular or plural, encompasses electrical connectors, fiber optic connectors, hydraulic connectors and pneumatic connectors, either singular or plural, respectively. Also, as used herein, the term "electrical connection", either singular or plural, encompasses electrical connections, fiber optic connections, hydraulic connections and pneumatic connections, respectively, either singular or plural.

While the present invention has been described with specific embodiments of the elements and their specific modes of cooperation and relationship, there are modifications which may be made without departing from the spirit of the invention. The scope of the invention is not limited by the specific illustrations or by the preferred embodiment and presently known best mode, as described hereinabove, but rather is defined by the following claims.

What is claimed is:

1. A connector segment comprising:

a) nut means for drawing said connector segment into engagement with a complementary connector segment;

b) ferrule means for engaging said complementary connector segment in a rotationally fixed relation, said ferrule means including ratchet means;

c) resilient pawl means for selective engagement with said ratchet means, said resilient pawl means being releasably engaged with said nut means such that said resilient pawl means rotates with said nut means when engaged, said resilient pawl means and said ratchet means cooperating to permit rotation of said nut means in a direction to engage said complementary connector segment and to prevent rotation of said nut means in an opposite direction; and d) release means for disengaging said resilient pawl means from said nut means such that said nut means may be rotated in a direction to disengage said connector segment from said complementary connector segment, said release means including means for accepting an external instrument to effect such disengaging.

2. The invention of claim 1, wherein said first connector and said complementary connector form an electrical connection when engaged.

3. The invention of claim 1, wherein said ratchet means comprises plural seat means, and said resilient pawl means comprises a ratchet spring having a plurality of spring fingers for selective engagement of said seat means, the number of said seat means and the number of said spring fingers being selected so that at least one of said spring fingers is disengaged from said seat means when at least one other of said spring fingers is engaged with said seat means.

4. The invention of claim 1, wherein said ratchet means comprises plural seat means, and said resilient pawl means comprises a ratchet spring with a plurality of equally spaced spring fingers extending therefrom; the number of said plural seat means being one greater or one less than a multiple of the number of said plurality of spring fingers.

5. The invention of claim 4, wherein said ratchet means comprises at least one ratchet tooth means.

6. The invention of claim 4, wherein said resilient pawl means further comprises at least one indent projection extending from said resilient pawl means and releasably engageable with said nut means such that said resilient pawl means rotates with said indent projection is engaged with said nut means.

7. The invention of claim 6, wherein said means for accepting includes a passage permitting said external instrument to contact and to disengage said at least one indent projection from said nut means.

8. The invention of claim 1, wherein said nut means comprises threads which function to draw said first connector segment into full engagement with said complementary connector segment by threadably engaging corresponding threads of said complementary connector segment.

9. The invention of claim 1, wherein said ferrule means comprises tubular extension means, projecting axially from said ferrule means, said tubular extension means which comprise means to engage cooperating elements of said complementary connector segment to maintain said ferrule means rotationally stationary in relation to said complementary connector segment.

10. A backshell assembly comprising:

a) nut means for drawing said backshell assembly into engagement with a connector segment;

b) ferrule means for engaging said connector segment in rotationally stationary relation, said ferrule means including ratchet means having a plurality of seat means;

c) a ratchet spring having a plurality of spring fingers for selective engagement of said seat means, and at least one indent projection engagable with said nut means such that said ratchet spring rotates with said nut means when said indent projection is engaged with said nut means, said seat means and said spring fingers cooperating to permit rotation of said nut means in a direction to engage said connector segment and to prevent rotation of said nut means in an opposite direction, the number of said seat means and the number of said spring fingers being selected so that at least one of said spring fingers is disengaged from said seat means when at least one other of said spring fingers is engaged with said seat means; and d) release means for permitting said at least one indent projection to be disengaged from said nut means thereby to allow said nut means to be rotated in a direction to disengage said backshell assembly from said connector segment, said release means including passage means for permitting a tool to be inserted therein to disengage each of said at least one indent projection from said nut means.

11. The invention of claim 10, wherein said ferrule means comprises teeth means projecting axially from said ferrule means to engage cooperating elements of said connector segment to maintain said ferrule means rotationally stationary in relation to said connector segment.

12. The invention of claim 10, wherein said nut means comprises threads which function to draw said backshell assembly into full engagement with said connector segment by threadably engaging corresponding threads of said connector segment.

13. The invention of claim 10, wherein said spring fingers are equally spaced and said number of said seat means is one less than a multiple of the number of said spring fingers.

14. The invention of claim 10, wherein said spring fingers are equally spaced and said number of said seat means is one greater than a multiple of the number of said spring fingers.

15. The invention of claim 10, wherein said backshell assembly and said connector segment are used in cooperation.

* * * * *